United States Patent [19]

Yamamoto et al.

[11] Patent Number: 4,524,669

[45] Date of Patent: Jun. 25, 1985

[54] KEY-DRIVING/DETECTING MECHANISM FOR KEYBOARD INSTRUMENT

[75] Inventors: Jun Yamamoto; Hajime Hayashida; Hiroyoshi Takahashi, all of Hamamatsu, Japan

[73] Assignee: Nippon Gakki Seizo Kabushiki Kaisha, Japan

[21] Appl. No.: 381,715

[22] Filed: May 24, 1982

[30] Foreign Application Priority Data

Jun. 11, 1981 [JP] Japan ..... 56-85999[U]
Jun. 12, 1981 [JP] Japan ..... 56-91119

[51] Int. Cl.[3] ..... G10C 3/12
[52] U.S. Cl. ..... 84/433; 84/435
[58] Field of Search ..... 84/115, 433, 435, 436, 84/437, 439

[56] References Cited

U.S. PATENT DOCUMENTS 3,160,052 12/1964 Von Gunten ..... 84/433
3,657,459 4/1972 Peterson et al. ..... 84/434
3,680,426 8/1972 Fry ..... 84/433
4,027,569 6/1977 Luce et al. ..... 84/433
4,176,578 12/1979 Campbell et al. .
4,338,848 7/1982 Rhodes ..... 84/433

*Primary Examiner*—Russell E. Adams
*Attorney, Agent, or Firm*—Blakely, Sokoloff, Taylor & Zafman

[57] ABSTRACT

A key-driving/detecting mechanism for performing automatically a keyboard instrument is constituted by a plurality of keys arranged on a key bed, each key being rotatable about a balance pin secured to a balance rail, and an electromagnetic device interposed between a lower surface of each key and the key bed at a position to the rear of the balance pin. Each electromagnetic device comprises an electromagnetic oil mounted on the key bed and a permanent magnet secured to a rear surface of the key. The simplicity of the key-driving-/detecting mechanism is implemented by this disposition of the electromagnetic device. In a modification a pair of electromagnetic devices are provided in front of and in rear of the balance pin.

14 Claims, 5 Drawing Figures

KEY-DRIVING/DETECTING MECHANISM FOR KEYBOARD INSTRUMENT

BACKGROUND OF THE INVENTION

This invention relates to a key-driving/detecting mechanism for performing automatically a keyboard instrument.

An automatic musical instrument has already been proposed wherein an automatic performance capability is provided for such keyboard instruments as a grand piano or an upright piano so as to enable an automatic performance in addition to a manual performance. One example of such musical instrument is disclosed in U.S. Pat. No. 3,160,052 issued on Dec. 8, 1964. According to this patent generally horizontal recessed surfaces are formed on the fore end of a generally horizontal bed frame, and a key-driving/detecting mechanism is disposed between the recess surfaces and respective keys. When the frame is worked so as to mount the key-driving mechanism the balance among the strength of the strings connected under tension to the piano frame may be disturbed. Especially, in recent years for the purpose of improving soundproof effect, a key bed is usually made of a polywood construction in which a layer of polyurethane is sandwiched between wood plates. Such key bed is impossible to work in a manner as above described due to its low mechanical strength so that it is essential to work the key bed and to reinforce the same.

When the frame is worked as above described and then incorporated into a piano already assembled with the key-driving mechanism from the rear side, it is difficult to form the recess surfaces.

In the prior art key-driving mechanism, an armature is pulled into a central opening of a solenoid coil secured on the frame on depressing a key. In this construction, however, alignment of the positions of the armature and the solenoid coil is troublesome.

SUMMARY OF THE INVENTION

Accordingly, it is a principal object of this invention to provide an improved key-driving/detecting mechanism for a keyboard instrument not requiring a special working of the frame.

Another object of this invention is to provide a novel automatic performance switch mechanism for a keyboard instrument capable of relatively readily incorporated into keyboard instruments on the market.

Still another object of this invention is to provide an improved key-driving/detecting mechanism for a keyboard instrument in which positional alignments of various portions are relatively easy.

A further object of this invention is to provide a driving/detecting mechanism which can not only provide an automatic performance with a relatively simple construction but also record performance key informations by converting the same into electric signals.

To accomplish these and other objects, according to this invention there is provided a key-driving/detecting mechanism for a keyboard instrument in which a plurality of keys are arranged on a key bed, each key being rotatable about a balance pin secured to a balance rail on the key bed, and an electromagnetic device is disposed between the lower surface of each key and the key bed at a position to the rear of the balance pin.

In a modification a pair of electromagnetic devices are provided in front of and to the rear of each balance pin.

DESCRIPTION OF THE PREFERRED EMBODIMENTS

Figure 1:
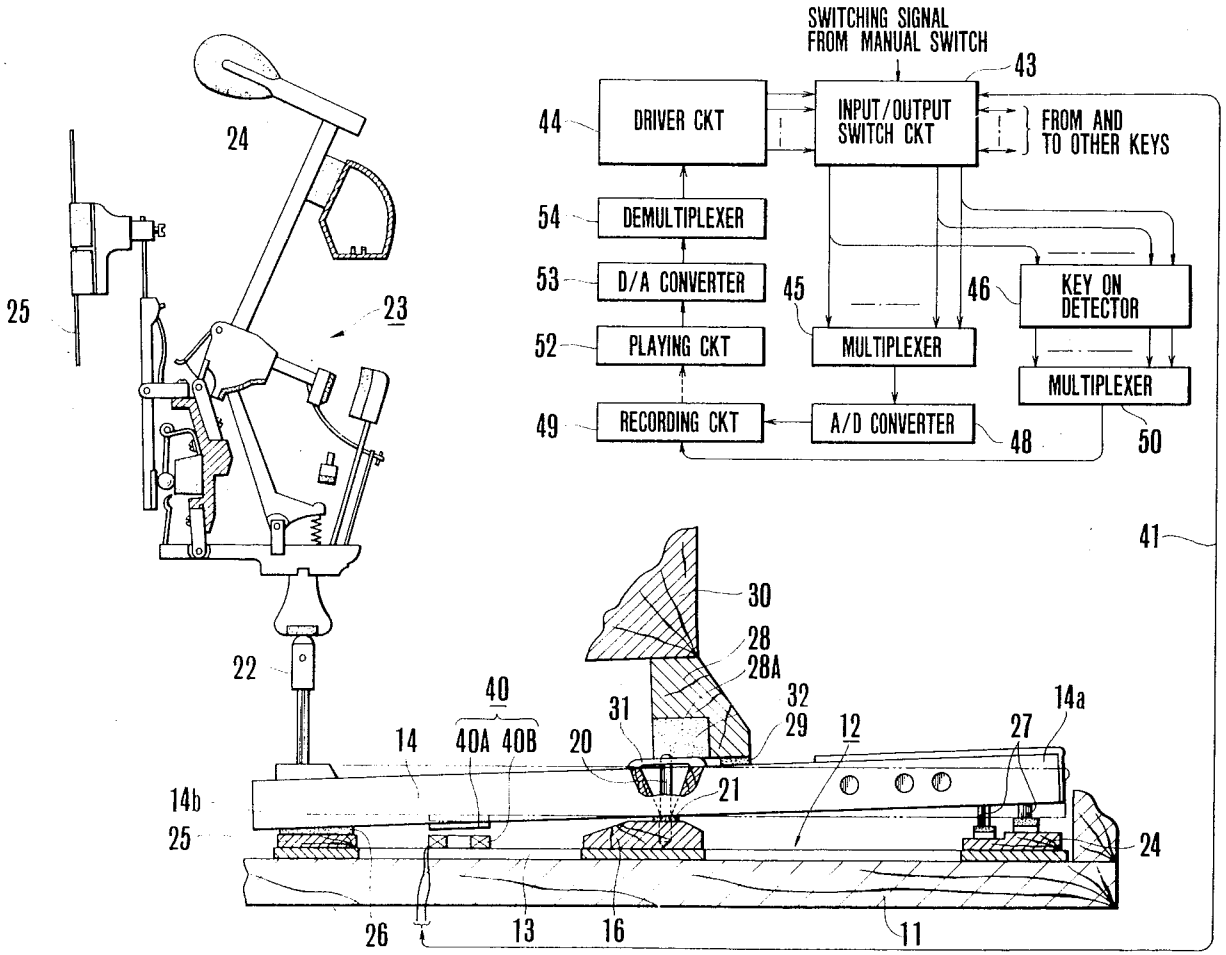
FIG. 1 shows a key-driving/detecting mechanism embodying the invention and utilized in a keyboard instrument and a basic block diagram of automatic performance apparatus.

The lefthand portion of FIG. 1 illustrates one embodiment of the key-driving/detecting mechanism embodying the invention for a keyboard instrument. As shown, a key frame 13 is mounted on the upper surface of a key bed 11 and keys 14 are mounted on the key frame 13 to be tiltable in the vertical direction about their central portions. More particularly, an intermediate portion of each key 14 is supported by a balance pin 20 secured to the upper surface of a balance rail 16. The intermediate portion of the key 14 is mounted on a layer of felt 21 so that when the righthand front end 14*a* is depressed, the key tilts in the vertical direction about an opening through which the pin 20 extends so as to raise the rear end 14*b*. Accordingly, a hammer 24 strikes a string 25 through a capstan button 22 mounted on the rear end 14*b* and a well known action mechanisms 23 to produce a sound. In this example, the rear end 14*b* of the key is mounted on a back rail 25 through a layer of felt 26, and a front pin 27 is secured to a front rail 24 so as to limit the vertical rotation of the key 14.

A key stop rail 28 is disposed above portions of all keys 14 and forwardly relative to the pins 20 at the centers of respective keys for overlying all keys through a layer of felt 29, and the opposite ends of the key stop rail 28 are joined to the inner sides of a pair of arms, not shown, constituting a well known casing of a musical instrument. The upper surface of the key stop rail 28 is bonded to the lower surface of one side of a cover 30 of the keyboard. The purpose of the layer of felt 29 is to limit the counterclockwise rotation of the keys 14 and to prevent key button 31 provided on the keys 14 and the balance pins 20 from escaping to the outside through gaps between the keys 14 and the key stop rail 28. In this example, a notch 28A is provided for the rear side of the key stop rail 28, and a clamping member 32 (made of felt, for example) is contained in a space defined by the notch 28A and the key button 31 for preventing all keys from rising at the time of the automatic performance to be described later.

The invention is characterized in that a combined drive and detector (hereinafter, merely called a key-driver/detector) 40 is disposed in a space between the rear ends 14*b* of the keys 14 and the key frame 13. The key-driver/detector 40 comprises a circular or rectangular flat permanent magnet 40A and an electromagnetic coil 40B disposed close thereto as shown in FIG.

1. Such driver/detector 40 is provided corresponding to each key. As shown in FIG. 1, the flat permanent magnet 40A is mounted on the rear surface of the rear end 14*b* of each key while the electromagnetic coil 40B comprises a flanged cylindrical bobbin, and a number of turns of a conductor wrapped about the bobbin as is well known in the art. The coil 40B is secured on the key frame 13 to oppose the permanent magnet 40A. The electromagnetic coil 40B is connected to an input/output switching circuit 43 via a conductor 41. The switching circuit 43 is connected to all electromagnetic coils corresponding to all keys and is also connected to receive the output of a driver circuit 44 for providing its output to a multiplexer 45 and a key-on detector 46. When a switching signal from a manual switch, not shown, is "1" that is in an automatic performance mode, the output of the driver circuit 44 is sent to the electromagnetic coils 40B, whereas when the switching signal is "0", that is in the case of the recording mode, the outputs of the electromagnetic coils are sent to the multiplexer 45 and the key-on detector 46.

The multiplexer 45 applies a product of all inputs to an analog/digital converter 48 and the digital output thereof is sent to a recording circuit 49. The key-on detector 46 is constructed such that, when the output level of the electromagnetic coils 40B supplied thereto via the input/output switching circuit 43 exceeds a predetermined threshold value, the key-on detector 46 supplies to a T flip-flop circuit a signal showing that the key-on detector 46 has detected this fact, and that the output of the flip-flop circuit is used as a key-on signal. Of course, the detector 46 may have other well known construction. The output of the key-on detector 46, that is a key-on signal corresponding to a depressed key is sent to the recording circuit 49 via the multiplexer 50. The recording circuit 49 comprises a magnetic tape, a magnetic disc or other recording mediums on which the output of the analog/digital converter 48 is recorded or stored with the timing of producing an output from the multiplexer 50. The data recorded in the recording circuit 49 are used as the automatic performance data.

To reproduce the data, the recorded data are converted into an electric signal by a playing or reproducing circuit 52, and the electric signal is converted into an analogue signal by a digital/analog converter 53 and then changed into signals corresponding to respective keys by a demultiplexer 54. The outputs of the demultiplexer 54 are supplied to members of the driver circuit 44 which drive the electromagnetic coils 40B of the keys to be depressed. When the input/output switching circuit 43 is in the performance mode, the drive circuit 44 sends its outputs to the electromagnetic coils 40B of corresponding keys.

When the input/output switching circuit 43 is in the automatic performance mode, the automatic performance data are sent to the driver circuit 44 via the reproducing circuit 52, the digital/analog converter 53, and the demultiplexer 54, and based on these data, the drive circuit 44 supplies drive currents to the electromagnetic coils 40B of the electromagnetic devices corresponding to the keys to be depressed thus energizing the coils. As a consequence, repulsive forces are created between the coils 40B and the permanent magnets 40A to raise the rear ends of the keys 14. The key stop rail 28 and felt 32 prevent keys from being raised as a whole. The above described operation of raising the rear ends of the keys is equivalent to the operation of manually depressing the front ends of the keys.

On the other hand, when the input/output switching circuit 43 is in the recording mode, electromagnetic coils 40B of depressed keys induce voltages therein. More particularly, the electromagnetic device of this invention comprises a coil and a permanent magnet cooperating therewith so that when the rear end of eac key is raised as a result of key depression, a voltage is induced in the electromagnetic coil 40B according to the righthand law of Fleming. This induced voltage is different depending upon the speed of key depression. The output of each electromagnetic coil 40B is sent to the multiplexer 45 and the key-on detector 46 via the input/output switching circuit 43. The output of the multiplexer 45 is sent to the recording circuit 49 via the analog/digital converter 48. The key-on signal detected by the key-on detector 46 is supplied to the recording circuit 49 via the multiplexer 50. Consequently, the recording circuit 49 stores the output of the analog/digital converter 48 in accordance with the key-on signal. The data recorded on the recording medium at this time, contain not only a key note or a key code but also an information regarding the speed of key depression. Where the time of generation of the induced voltage is also included in the information, it is possible to obtain an information regarding the force of key depression. Accordingly, it should be noted that the output of the driver circuit 44 in the reproduction mode is a current having a magnitude corresponding to the speed of key depression.

According to the construction of this invention described above there are the following merits.

(1) Since an electromagnetic device is disposed between each key and a key bed at a position behind a balance pin of the key and since the key bed and the key do not require any special work that decreases their strength, it is possible to add an automatic performance capability to a keyboard instrument without decreasing the strength of a frame as in the prior art construction.

(2) Any special work is not necessary for the key bed so that the key-driving/detecting mechanism of this invention can be readily incorporated into a keyboard instrument on the market. Moreover it is easy to adjust the mechanism.

(3) Further, since the electromagnetic device utilized in this invention comprises a simple combination of an electromagnetic coil and a flat permanent magnet, it is possible to provide a repulsive force sufficient to raise the key.

(4) Since electromagnetic device utilized in this invention has a compact construction and a small height, it is not necessary to use highly accurate positioning operation for mounting the electromagnetic device.

(5) As the electromagnetic device is constituted by a permanent magnet and an electromagnetic coil it is possible to derive out an electric signal from the electromagnetic coil so that the electromagnetic device can provide both of the reproduction and recording performances. This means a decrease in the number of the component parts to be incorporated into the keyboard instrument.

(6) Since a clamping member is mounted above the center of the key, that is the pivot point thereof it is possible to prevent rising of the key as a whole when the electromagnetic device is operated.

(7) According to this embodiment, since the electromagnetic switch is interposed between the back rail and the balance rail the electromagnetic device can function as desired. In addition, the shock applied to the rear end of the key can be absorbed by such absorber as a layer of felt. For this reason, it is possible to reduce, as far as possible, the spacing between the permanent magnet and the coil for producing a large repulsive force.

(8) Where the electromagnetic device is disposed on the rear side of the key, the heat generated by the electromagnetic device can be dissipated by a suitable heat pipe provided for the keyboard instrument.

Figure 2:
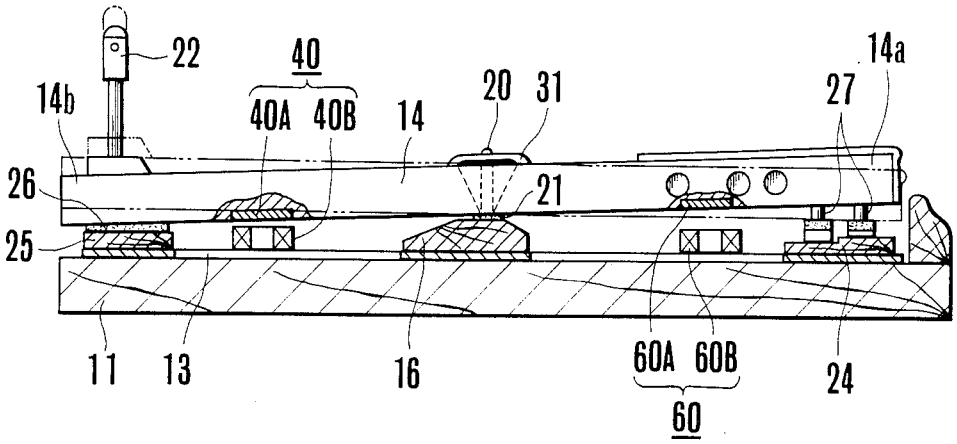
FIG. 2 is a side view showing a modified key-driving-/detecting mechanism.

FIG. 2 shows another embodiment of this invention which is different from the embodiment shown in FIG. 1 in that a second combined drive and detector 60 (hereinafter called a second key switch) is disposed between the front portion 14*a* of a key 14 and the key frame 13. The second key-driver/detector 60 has the same construction as the first key-driver/detector 40. Thus, it comprises a permanent magnet 60A embedded in the lower surface of the front end 14*a* of the key, and an electromagnetic coil 60B mounted on the key frame 13 to confront the permanent magnet 60A. When current is passed through the electromagnetic coil 60B, the permanent magnet 60A is attracted to pull down the key 14. When the permanent magnet is magnetized in the vertical direction, current is passed through the coil such that a magnetic field opposite to that of the permanent magnet 60A will be formed. Of course, the direction of magnetization of the permanent magnet may be reversed in which case the direction of winding the coil is reversed.

When the first and second key-drivers/detectors are combined in this manner, the driving/detecting mechanism shown in FIG. 2 operates as follows. Thus, when exciting currents are passed through the electromagnetic coils 40B and 60B of the first and second key-drivers/detectors 40 and 60, the first key-driver/detector 40 produces a repulsive force between the permanent magnet 40A and the electromagnetic coil 40B, whereas in the second key-driver/detector 60, an attractive force is created between the permanent magnet 60A and the electromagnetic coil 60B so that a couple caused by these two forces acts on the key 14. Consequently, the key 14 operates as if it were depressed manually to raise the capstan button 22.

As the currents through the coils 40B and 60B cease, the attractive force and the repulsive force described above disappear so that the key 14 is returned to the original position by the load of the action mechanism.

Figure 3:
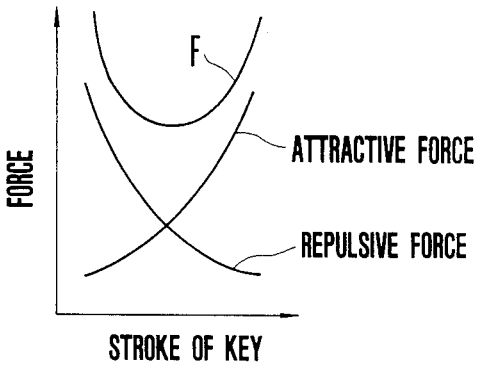
FIG. 3 is a graph showing the relationship between the key stroke and the force when two driving/detecting mechanisms are used.

FIG. 3 is a graph showing the relation among the stroke of the key, attractive force and repulsive force. The resultant F of the attractive force and the repulsive force is an actual drive force of the key 14. The resultant force F can be adjusted to any value by changing the characteristics of the first and second key-drivers/detectors 40 and 60.

Since this modified embodiment utilizes the attractive force and the repulsive force of the first and second key-drivers/detectors 40 and 60, it is possible to produce a large drive force whereby the key 14 can be actuated positively. Moreover, this key-driving/detecting mechanism has a simple construction, requires less number of component parts, and does not require any work for the key bed. Furthermore, mounting and adjustment of the key-driving/detecting mechanism are easy.

When compared with the embodiment shown in FIG. 1 utilizing only one electromagnetic switch it is possible to decrease currents passing through respective coils thus decreasing heat generation. Further, it is possible to miniaturize the driving/detecting mechanism by decreasing the number of turns of the electromagnetic coils.

The forces produced by the first and second key-drivers/detectors may be combined as shown in the following Table which can be readily understood by one skilled in the art without any logical description.

TABLE

| case | first driver/detector (40) | second driver/detector (60) |
|---|---|---|
| 1 | repulsion (normal) | attraction (normal) |
| 2 | repulsion (strong) | attraction (weak) |
| 3 | repulsion (weak) | attraction (strong) |
| 4 | repulsion (strong) | attraction (weak) |

Figure 4:
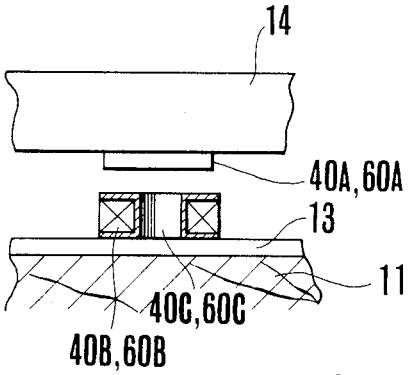
FIG. 4 shows a modified construction of an electromagnetic device.

FIG. 4 shows a modification of the electromagnetic device utilized in each of the foregoing embodiments. In addition to the combinations of the permanent magnets 40A and 60A and troidal coils 40B and 60B described above, there are provided magnetic cores 40C or 60C at the center of the magnetic coil for the purpose of decreasing its reluctance. This improvement makes it possible to further increase the repulsive force and the attractive force. Since in this modification a small gap, for example of the order of 0.5 mm, is left when the permanent magnet approaches the electromagnetic coil so that the attractive force caused by the permanent magnet is reduced to a value not to increase the key touch feeling when the permanent magnet approaches electromagnetic coil.

Figure 5:
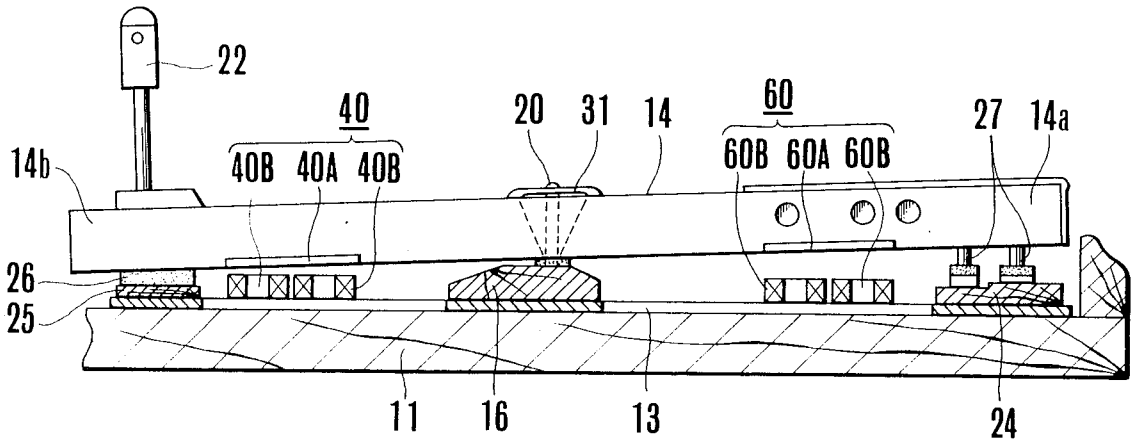
FIG. 5 is a side view showing another modified key-driving/detecting mechanism embodying the invention.

FIG. 5 is a side view showing an improvement of the embodiment shown in FIG. 2. In this improvement for the purpose of increasing the drive force for the key 14 two electromagnetic coils are provided for each of the first and second key-drivers/detectors 40 and 60 and the lengths of the permanent magnets 40A and 60A are increased in the direction of length of the key 14 for cooperating with two coils. It will be clear that the number of coils is not limited to two. When electromagnetic coils of any number are energized depending upon the tone volume, speed etc., dynamic range can be changed freely.

Although in the foregoing embodiment, the second key-driver/detector was constituted by a permanent magnet 60A and an electromagnetic coil 60B, the invention is not limited to such specific construction, and the key-driving/detecting mechanism may be constructed such that an attractive force is created by a magnetic member and an electromagnetic coil.

Although, in this embodiment the magnet 40A was secured on the rear side of the key and the coil 40B on the key frame 13 any other fastening means, for example screws may be used. Further, instead of mounting the electromagnetic coil 40B on the key bed 11 through the key frame 13, the coil may be directly mounted.

Alternatively, the permanent magnet or magnetic member may be mounted on the key frame or the key bed and the electromagnetic coil may be mounted on the rear surface of the key.

Although in the foregoing embodiment the first key-driver/detector was constituted by a permanent magnet and an electromagnetic coil, where a combination of first and second key-drivers/detectors is used as shown in FIG. 2, each key driver/detector may be constituted by a combination of a magnetic member and an electromagnetic coil, and a core may be added. The difference between the attractive forces of two key-drivers/detectors may be used to operate a key. For example, the attractive force of the first key-driver/detector may be made to be smaller than that of the second key-driver/detector. In this case, however, recording is not possible.

What is claimed is:

1. A key-driving/detecting mechanism for a keyboard instrument comprising:

a plurality of keys arranged on a key bed;

each key being rotatable about a balance pin secured to said key bed;

a first electromagnetic device interposed between a lower surface of each key and said key bed at a position in rear of said balance pin, each of said first devices comprised of an electromagnetic coil and a permanent magnet; and a second electromagnetic device interposed between said lower surface of each key and said key bed at a position in front of said balance pin, each of said second devices comprised of an electromagnetic coil and a permanent magnet.

2. A key-driving/detecting mechanism according to claim 1 wherein each of said first electromagnetic devices are arranged in the longitudinal direction of its corresponding key.

3. A key-driving/detecting mechanism according to claim 1 wherein each of said first electromagnetic devices further comprises a magnetic core contained in its said corresponding coil.

4. A key-driving/detecting mechanism according to claim 1, 2 or 3, which further comprises a back rail mounted on said key bed at a position corresponding to a rear end of each key, and a cushion member mounted on said back rail.

5. A key-driving/detecting mechanism according to claim 1, 2 or 3 which further comprises a key clamping member disposed on each key engaging said balancing key.

6. A key-driving/detection mechanism according to claim 1 wherein said electromagnetic coil of each of said first devices is mounted on said key bed, and said corresponding permanent magnet is mounted on a rear surface of a corresponding key.

7. A key-driving/detecting mechanism according to claim 6 wherein each of said permanent magnets are embedded in the rear surface of said corresponding key.

8. A key-driving/detecting mechanism according to claim 6 wherein each of said permanent magnets are secured to the rear surface of said corresponding key.

9. A key-driving/detecting mechanism according to claim 1 wherein at least one of the electromagnetic devices further comprises a magnetic core disposed within its said corresponding electromagnetic coil.

10. The key-driving/detecting mechanism defined by claim 1 further comprising:

a back rail mounted on said key bed at a position corresponding to a rear end of each key;

a cushion member mounted on said back rail;

a front rail mounted on said key bed at a position corresponding to a front end of each key; and a cushion member mounted on said front rail.

11. A key-driving/detecting mechanism according to claim 1 wherein said driving/detecting mechanism further comprises a coil drive circuit connected to said electromagnetic coil and means for supplying an automatic performance signal to said drive circuit.

12. A key-driving/detecting mechanism according to claim 1 wherein said driving/detecting mechanism comprises an input/output switching circuit connected to each of said electromagnetic coils, a first multiplexer connected to receive an output of said switching circuit, a key-on detector for producing a key-on signal in response to the output of said switching circuit, a second multiplexer supplied with an output of said key-on detector, an analogue/digital converter for converting an analogue output of said first multiplexer into a digital signal, a recording circuit which records said digital signal at a time of producing an output from said second multiplexer, a digital/analogue converter which converts an output of said recording circuit into an analogue signal, a demultiplexer which demultiplexes said analogue signal, and a drive circuit for supplying an output to said input/output switching circuit in response to an output of said demultiplexer.

13. A key-driving/detecting mechanism according to claim 12 wherein said input/output switching circuit switches an input and an output in response to a manually controlled input.

14. A key-driving/detecting mechanism comprising:

a plurality of keys arranged on a key bed;

each key being rotatable about a balance pin secured to a balance rail on a key bed;

first and second electromagnetic devices interposed between a lower surface of each key and said key bed, said first and second electromagnetic devices being located in front of and to the rear of said balance pin of each key;

each of said first and second electromagnetic devices comprising a combination of a magnetic member and an electromagnetic coil cooperating therewith;

the electromagnetic coils of said first and second electromagnetic devices being proportioned such that, when energized, said first electromagnetic device produces an attractive force larger than that produced by said second electromagnetic device.

* * * * *